US008558644B2

(12) United States Patent
Ryu et al.

(10) Patent No.: US 8,558,644 B2
(45) Date of Patent: Oct. 15, 2013

(54) HIGH EFFICIENCY RESONATOR FOR WIRELESS POWER TRANSMISSION

(75) Inventors: Young Ho Ryu, Yongin-si (KR); Eun Seok Park, Suwon-si (KR); Sang Wook Kwon, Seongnam-si (KR); Young Tack Hong, Seongnam-si (KR); Nam Yun Kim, Seoul (KR); Jung Hae Lee, Seoul (KR); Jae Hyun Park, Seoul (KR); Byung Chul Park, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 359 days.

(21) Appl. No.: 12/967,900

(22) Filed: Dec. 14, 2010

(65) Prior Publication Data

US 2011/0140807 A1 Jun. 16, 2011

(30) Foreign Application Priority Data

Dec. 14, 2009 (KR) ..... 10-2009-0124268

(51) Int. Cl.
*H01P 7/00* (2006.01)

(52) U.S. Cl.
USPC ..... 333/219; 333/219.2

(58) Field of Classification Search
USPC ..... 333/219, 219.1, 219.2, 221, 223, 234, 333/235
See application file for complete search history.

(56) References Cited

U.S. PATENT DOCUMENTS

| | | | | |
|---|---|---|---|---|
| 3,766,494 | A * | 10/1973 | Anbe et al. | 331/99 |
| 4,963,843 | A | 10/1990 | Peckham | |
| 7,525,711 | B1 * | 4/2009 | Rule et al. | 359/244 |
| 8,174,341 | B2 * | 5/2012 | Lee et al. | 333/219 |
| 2008/0164960 | A1 | 7/2008 | Schnell et al. | |
| 2011/0140809 | A1 * | 6/2011 | Ryu et al. | 333/219 |

FOREIGN PATENT DOCUMENTS

| | | |
|---|---|---|
| JP | 11-27013 | 1/1999 |
| JP | 11-56809 | 3/1999 |
| JP | 2000-183606 | 6/2000 |
| JP | 2009-164482 | 7/2009 |

* cited by examiner

*Primary Examiner* — Dean O Takaoka
(74) *Attorney, Agent, or Firm* — NSIP Law

(57) ABSTRACT

Provided is a resonator for a wireless power transmission, the resonator including a transmission line unit including a plurality of transmission line sheets arranged in parallel, and a capacitor provided at a predetermined position of the transmission line unit.

9 Claims, 6 Drawing Sheets

HIGH EFFICIENCY RESONATOR FOR WIRELESS POWER TRANSMISSION

CROSS-REFERENCE TO RELATED APPLICATION

This application claims the benefit under 35 U.S.C. §119 (a) of Korean Patent Application No. 10-2009-0124268, filed on Dec. 14, 2009, in the Korean Intellectual Property Office, the entire disclosure of which is incorporated herein by reference for all purposes.

BACKGROUND

1. Field

The following description relates to a wireless power transmission system, and more particularly, to a resonator for a wireless power transmission.

2. Description of Related Art

Recently, techniques for wireless power transmission are increasingly attracting attention. Particularly, supplying wireless power to various types of mobile devices such as a cell phone, a laptop computer, an MP3 player, and the like may be a favorable application of the techniques for the wireless power transmission. One of the techniques for the wireless power transmission may use a resonance characteristic of a radio frequency (RF) device.

A wireless power transmission system using the resonance characteristic may include a source to supply power and a destination to receive the supplied power. In such a case, when the destination is a mobile device, the source and the destination may be located close to each other. Therefore, in the wireless power transmission system including a resonator, the resonator may need to have a short power transmission length. To provide the short power transmission length, the resonator may have a large form factor.

A physical size of the resonator for the wireless power transmission with the large form factor may be relatively large, and accordingly a power transmission efficiency may be relatively low. In a general resonator for the wireless power transmission, a resonance frequency may depend on the physical size of the resonator. This may be a barrier to reducing the size of the resonator for the wireless power transmission.

Accordingly, there is a desire for manufacturing the resonator for the wireless power transmission with a relatively small size and increasing the efficiency.

SUMMARY

Provided is a resonator having a plurality of transmission line elements arranged in parallel, and for which a resonance frequency may be changed without changing a physical size of the resonator.

Additional aspects will be set forth in part in the description which follows and, in part, will be apparent from the description, or may be learned by practice of the various example embodiments.

The foregoing and/or other features and utilities may be achieved by providing a resonator for a wireless power transmission, the resonator including a transmission line unit including a plurality of transmission line sheets arranged in parallel, and a capacitor provided at a predetermined position of the transmission line unit.

The capacitor may be provided in series in an intermediate portion of the transmission line unit.

The capacitor may be configured so that the resonator may have a property of a metamaterial.

The capacitor may be configured so that the resonator may have a negative magnetic permeability at a target frequency.

The transmission line unit may be configured to have a parallel type conductor loss.

The transmission line unit may be configured to have an in-phase electric current flow.

The transmission line unit may be configured such that a current supplied to the resonator may be uniformly distributed on the plurality of transmission line sheets.

The resonator may further include a magnetic core to pass through the transmission line unit.

The foregoing and/or other features and utilities may also be achieved by providing a resonator for a wireless power transmission, the resonator including a plurality of transmission lines provided adjacent to one another, and a capacitor provided at a gap in the transmission lines.

The capacitor may be provided in series with the transmission lines.

The resonator may further include a matcher to adjust a magnetic field strength of the resonator, and the capacitor may be provided opposite to the matcher in the resonator.

Other features and aspects will be apparent from the following detailed description, the drawings, and the claims.

Figure 1:
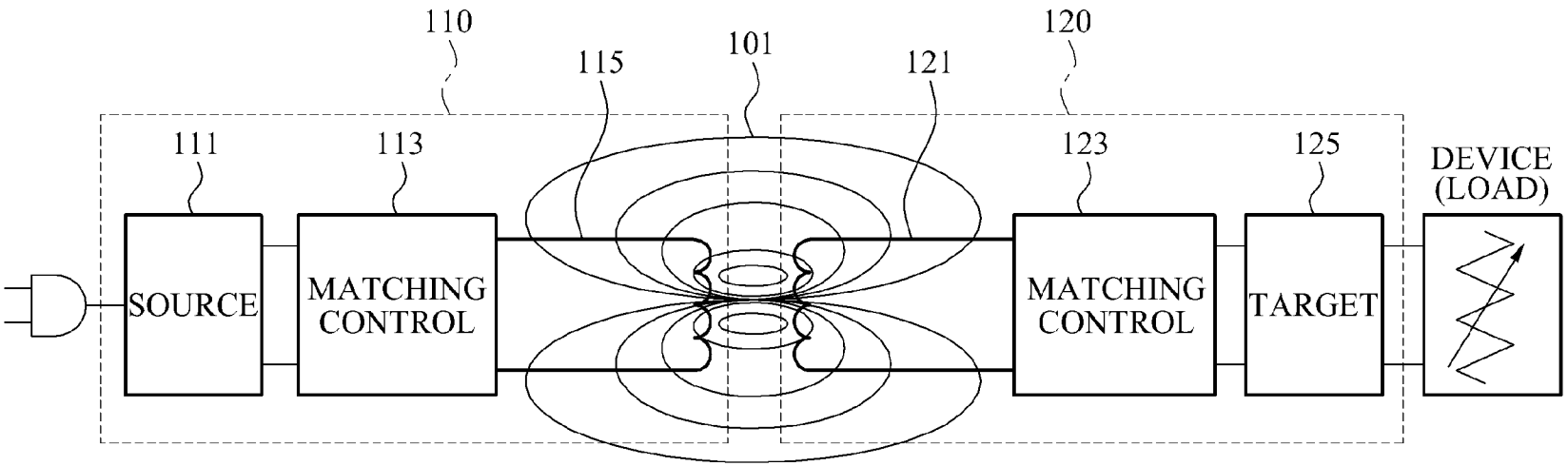
FIG. 1 is a diagram illustrating an example of a wireless power transmission system.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of operations is not limited to that set forth herein and may be changed as is known in the art, with the exception of operations necessarily occurring in a certain order. Also, description of well-known functions and constructions may be omitted for increased clarity and conciseness.

FIG. 1 illustrates an example of a wireless power transmission system.

In this described example, wireless power transmitted using the wireless power transmission system may be assumed to be a resonance power.

Referring to FIG. 1, the wireless power transmission system may have a source-target structure including a source and a target. The wireless power transmission system may include a resonance power transmitter 110 corresponding to the source and a resonance power receiver 120 corresponding to the target.

The resonance power transmitter 110 may include, for example, a source unit 111 and a source resonator 115. The source unit 111 may receive energy from an external voltage supplier to generate a resonance power. The resonance power transmitter 110 may further include a matching control 113 to perform functions such as, for example, resonance frequency or impedance matching.

The source unit 111 may include an alternating current (AC)-to-AC (AC/AC) converter, an AC-to-direct current (DC) (AC/DC) converter, and/or a DC-to-AC (DC/AC) inverter. The AC/AC converter may adjust, to a desired level, a signal level of an AC signal input from an external device. The AC/DC converter may output a DC voltage at a predetermined level by rectifying an AC signal output from the AC/AC converter. The DC/AC inverter may generate an AC signal in a band of a few megahertz (MHz) to tens of MHz by quickly switching a DC voltage output from the AC/DC converter.

The matching control 113 may set a resonance bandwidth of the source resonator 115 and/or an impedance matching frequency of the source resonator 115. Although not illustrated in FIG. 1, the matching control 113 may include a source resonance bandwidth setting unit and/or a source matching frequency setting unit. The source resonance bandwidth setting unit may set the resonance bandwidth of the source resonator 115. The source matching frequency setting unit may set the impedance matching frequency of the source resonator 115. For example, a Q-factor of the source resonator 115 may be determined based on a setting of the resonance bandwidth of the source resonator 115 or a setting of the impedance matching frequency of the source resonator 115.

The source resonator 115 may transfer electromagnetic energy to a target resonator 121. For example, the source resonator 115 may transfer the resonance power to the resonance power receiver 120 through magnetic coupling 101 with the target resonator 121. The source resonator 115 may resonate within the set resonance bandwidth.

The resonance power receiver 120 may include, for example, the target resonator 121, a matching control 123 to perform resonance frequency and/or impedance matching, and a target unit 125 to transfer the received resonance power to a load.

The target resonator 121 may receive the electromagnetic energy from the source resonator 115. The target resonator 121 may resonate within the set resonance bandwidth.

The matching control 123 may set a resonance bandwidth of the target resonator 121 and/or an impedance matching frequency of the target resonator 121. Although not illustrated in FIG. 1, the matching control 123 may include a target resonance bandwidth setting unit and/or a target matching frequency setting unit. The target resonance bandwidth setting unit may set the resonance bandwidth of the target resonator 121. The target matching frequency setting unit may set the impedance matching frequency of the target resonator 121. Here, a Q-factor of the target resonator 121 may be determined based on a setting of the resonance bandwidth of the target resonator 121 or a setting of the impedance matching frequency of the target resonator 121.

The target unit 125 may transfer the received resonance power to the load. The target unit 125 may include, for example, an AC/DC converter and a DC/DC converter. The AC/DC converter may generate a DC voltage by rectifying an AC signal transmitted from the source resonator 115 to the target resonator 121. The DC/DC converter may supply a rated voltage to a device or the load by adjusting a voltage level of the DC voltage.

The source resonator 115 and the target resonator 121 may be configured, for example, in a helix coil structured resonator, a spiral coil structured resonator, a meta-structured resonator, and the like.

Referring to FIG. 1, a process of controlling the Q-factor may include setting the resonance bandwidth of the source resonator 115 and the resonance bandwidth of the target resonator 121, and transferring the electromagnetic energy from the source resonator 115 to the target resonator 121 through magnetic coupling 101 between the source resonator 115 and the target resonator 121. The resonance bandwidth of the source resonator 115 may be set to be wider or narrower than the resonance bandwidth of the target resonator 121. For example, an unbalanced relationship between a BW-factor of the source resonator 115 and a BW-factor of the target resonator 121 may be maintained by setting the resonance bandwidth of the source resonator 115 to be wider or narrower than the resonance bandwidth of the target resonator 121.

In a wireless power transmission employing a resonance scheme, the resonance bandwidth may be an important factor. In an example in which the Q-factor, considering a change in a distance between the source resonator 115 and the target resonator 121, a change in the resonance impedance, impedance mismatching, a reflected signal, and the like, is represented by the value Qt, Qt may have an inverse-proportional relationship with the resonance bandwidth, as given by Equation 1.

$$\frac{\Delta f}{f_0} = \frac{1}{Qt} = \Gamma_{S,D} + \frac{1}{BW_S} + \frac{1}{BW_D} \quad \text{[Equation 1]}$$

In Equation 1, $f_0$ denotes a central frequency, $\Delta f$ denotes a change in a bandwidth, $\Gamma_{S,D}$ denotes a reflection loss between the source resonator 115 and the target resonator 121, $BW_S$ denotes the resonance bandwidth of the source resonator 115, and $BW_D$ denotes the resonance bandwidth of the target resonator 121. In the presently described example, the BW-factor may indicate either $1/BW_S$ or $1/BW_D$.

Due to an external effect, for example, a change in the distance between the source resonator 115 and the target resonator 121, a change in a location of the source resonator 115 and/or the target resonator 121, and/or other like changes, impedance mismatching between the source resonator 115 and the target resonator 121 may occur. The impedance mismatching may be a direct cause in decreasing an efficiency of power transfer. In an example in which a reflected wave corresponding to a transmission signal that is partially reflected and returned is detected, the matching control 113 may determine that impedance mismatching has occurred, and may perform impedance matching. For example, the matching control 113 may change a resonance frequency by detecting a resonance point through a waveform analysis of the reflected wave. The matching control 113 may determine, as the resonance frequency, a frequency having a minimum amplitude in the waveform of the reflected wave.

A source resonator and/or a target resonator may be configured as, for example, a helix coil structured resonator, a spiral coil structured resonator, a meta-structured resonator, and the like.

Hereinafter, related terms will be described for concise understanding. All the materials may have a unique magnetic permeability, i.e., Mu and a unique permittivity, i.e., epsilon. The magnetic permeability indicates a ratio of a magnetic flux density occurring with respect to a given magnetic field in a corresponding material to a magnetic flux density occurring with respect to the given magnetic field in a vacuum state. The permittivity indicates a ratio of an electric flux density occurring with respect to a given electric field in a corresponding material to an electric flux density occurring with respect to the given electric field in a vacuum state. The magnetic permeability and the permittivity may determine a propagation constant of a corresponding material in a given frequency or a given wavelength. An electromagnetic characteristic of the corresponding material may be determined based on the magnetic permeability and the permittivity. More particularly, a material having a magnetic permeability or a permittivity absent in nature and being artificially designed is referred to as a metamaterial. The metamaterial may be easily disposed in a resonance state even in a relatively large wavelength area or a relatively low frequency area. For example, even though a material size rarely varies, the metamaterial may be easily disposed in the resonance state.

Figure 2:
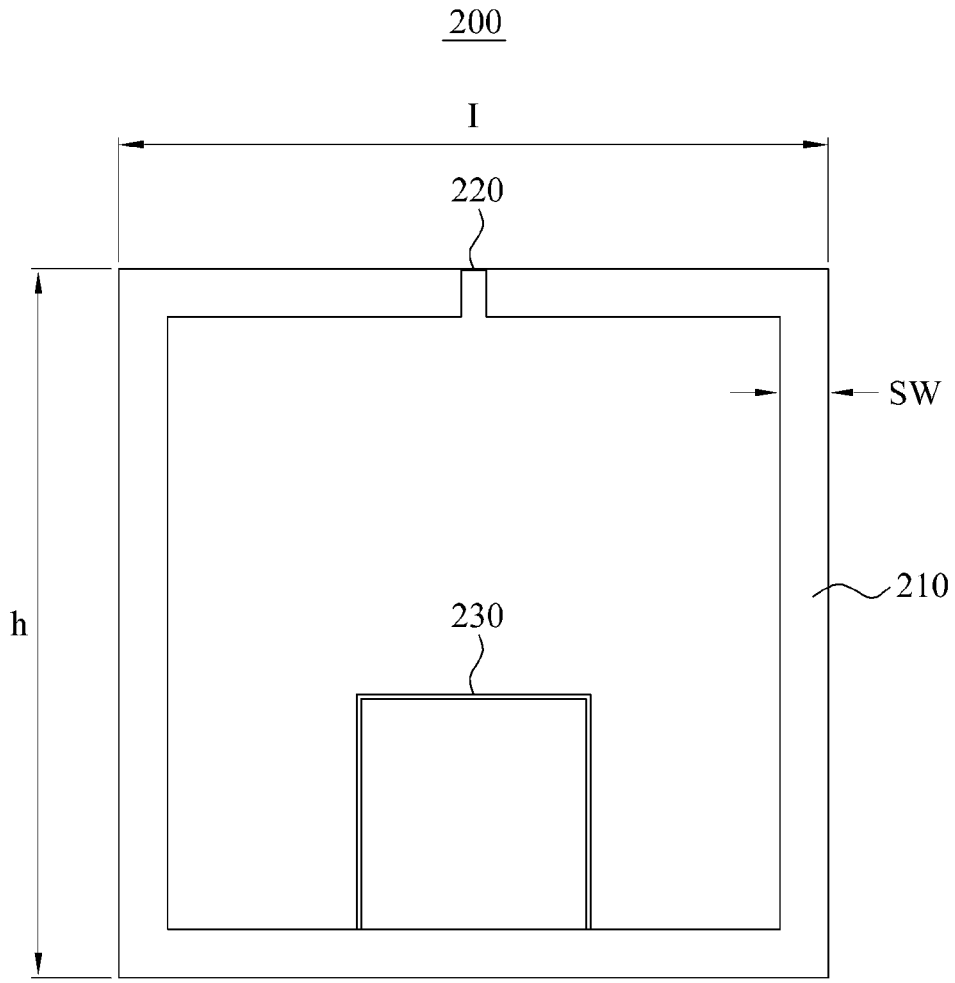
FIG. 2 is a diagram illustrating an example of a resonator for a wireless power transmission.
Figure 3:
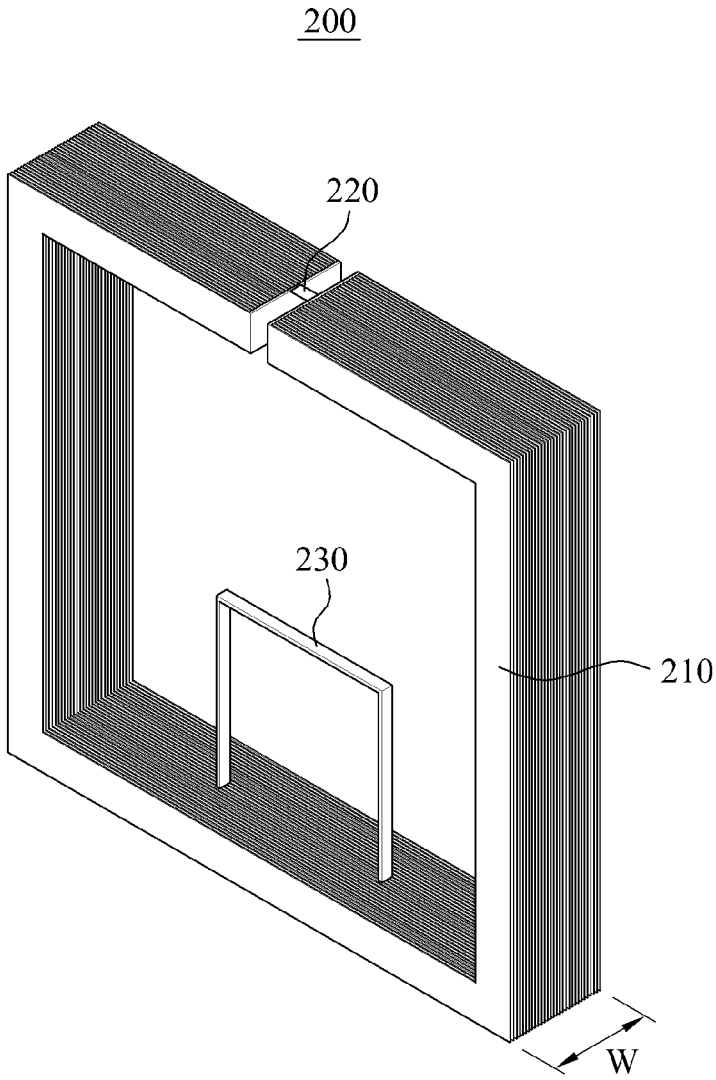
FIG. 3 is a side view illustrating an example of the resonator of FIG. 2.

FIG. 2 is a diagram illustrating an example of a resonator 200 for a wireless power transmission. FIG. 3 is a side view illustrating an example of the resonator 200 of FIG. 2.

Referring to FIG. 2, the resonator 200 for a wireless power transmission according to an example embodiment may include a transmission line unit 210 and a capacitor 220. The resonator 200 according to an example embodiment may further include a matcher 230.

The transmission line unit 210 may have a plurality of transmission line sheets arranged in parallel and adjacent to one another. A configuration in which the plurality of transmission line sheets are arranged in parallel is further described with reference to FIG. 4.

The capacitor 220 may be inserted into a predetermined position of the transmission line unit 210. Here, the capacitor 220 may be inserted in series into an intermediate portion of the transmission line unit 210. An electric field generated in the resonator 200 may be confined within the capacitor 220.

The capacitor 220 may be inserted into the transmission line unit 210 in a shape of a lumped element, a distributed element, or the like. For example, the capacitor 20 may be provided in a shape of an interdigital capacitor or a gap capacitor with a substrate having a relatively high permittivity in the middle. As the capacitor 220 is inserted into the transmission line unit 210, the resonator 200 may have a property of a metamaterial.

The term metamaterial indicates a material having a predetermined electrical property that cannot be discovered in nature, and thus may have an artificially designed structure. An electromagnetic characteristic of materials existing in nature may have a unique magnetic permeability or a unique permittivity. Most materials may have a positive magnetic permeability or a positive permittivity. In the case of most materials, a right hand rule may be applied to an electric field, a magnetic field, and a pointing vector, and thus the corresponding materials may be referred to as right handed materials (RHMs). However, the metamaterial has a magnetic permeability or a permittivity less than "1", and thus may be classified into an epsilon negative (ENG) material, a mu negative (MNG) material, a double negative (DNG) material, a negative refractive index (NRI) material, a left-handed (LH) material, and the like, based on a sign of the corresponding permittivity or magnetic permeability.

In an example in which a capacitance of the capacitor 220 inserted as the lumped element is appropriately determined, the resonator 200 may have the characteristic of the metamaterial. Since the resonator 200 may have a negative magnetic permeability by appropriately adjusting the capacitance of the capacitor 220, the resonator 200 according to an example embodiment may be referred to as an MNG resonator 200.

The MNG resonator may have a zeroth order resonance characteristic of having, as a resonance frequency, a frequency when a propagation constant is "0". Since the MNG resonator 200 may have the zeroth order resonance characteristic, the resonance frequency may be independent with respect to a physical size of the MNG resonator 200. By appropriately designing the capacitor 220, the MNG resonator 200 may sufficiently change the resonance frequency. Accordingly, the physical size of the MNG resonator 200 may not need to be changed in order to change the resonance frequency.

In a near field, the electric field may be concentrated on the series capacitor 220 inserted into the transmission line unit 210. Accordingly, due to the series capacitor 220, the magnetic field may become dominant in the near field.

The MNG resonator 200 may have a relatively high Q-factor using the capacitor 220 as the lumped element, and thus it is possible to enhance a power transmission efficiency.

The matcher 230 may feed a current to the MNG resonator 200. The matcher 230 may be configured so that a current supplied to the resonator 200 may be uniformly distributed on the plurality of transmission line sheets. According to an example embodiment, the matcher 230 may appropriately adjust a strength of a magnetic field of the MNG resonator 200.

Although not illustrated in FIG. 2, the resonator 200 may further include a magnetic core to pass through the MNG resonator 200. The magnetic core may enhance a power transmission distance.

The resonator 200 for the wireless power transmission illustrated in FIG. 2 may have a zeroth resonance characteristic. For example, when a propagation constant is "0", the resonator for the wireless power transmission may be assumed to have $\omega_{MZR}$ as a resonance frequency. The resonance frequency $\omega_{MZR}$ may be expressed by Equation 2.

$$\omega_{MZR} = \frac{1}{\sqrt{L_R C_L}} \quad \text{[Equation 2]}$$

In Equation 2, MZR denotes a Mu zero resonator. $C_L$ denotes a value corresponding to the capacitor 220 inserted into the intermediate portion of the transmission line unit 210. $L_R$ denotes a value corresponding to an inductance that an equivalent circuit of FIG. 2 may have.

Referring to Equation 2, the resonance frequency $\omega_{MZR}$ the resonator may be determined by $L_R/C_L$. A physical size of the resonator and the resonance frequency $\omega_{MZR}$ may be independent with respect to each other. Since the physical sizes are independent with respect to each other, the physical size of the resonator may be sufficiently reduced.

Figure 4:
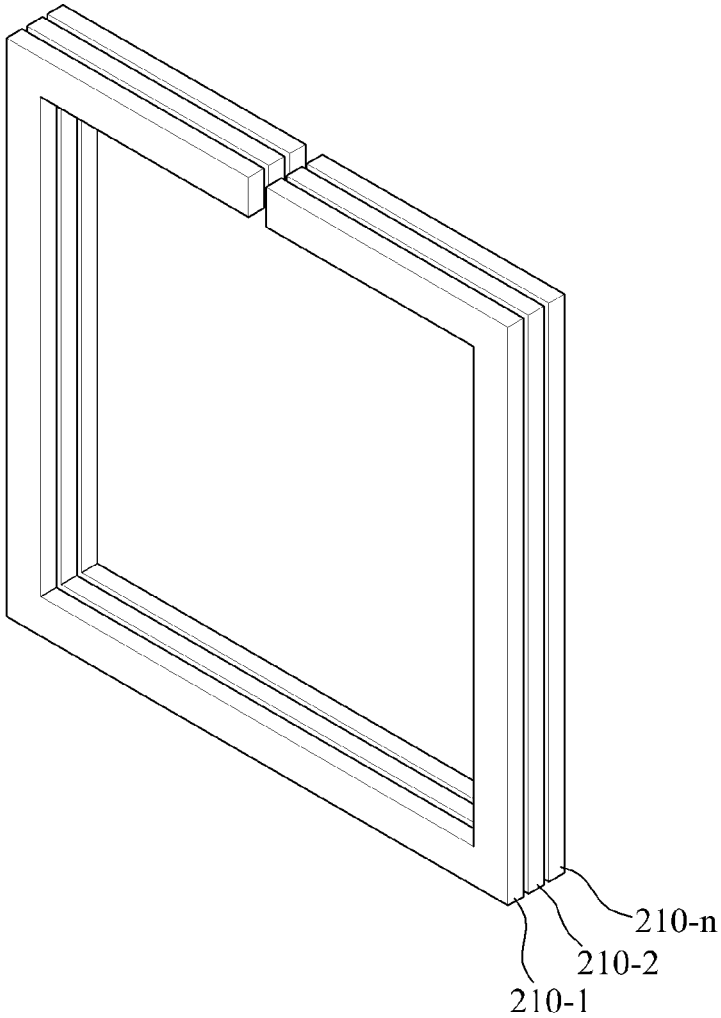
FIG. 4 is a diagram illustrating an example of the transmission line unit 210 of FIG. 2.

FIG. 4 is a diagram illustrating an example of the transmission line unit 210 of FIG. 2.

Referring to FIG. 4, the transmission line unit 210 may include a plurality of adjacent transmission line sheets 210-1, 210-2, and **210-*n*. Although three transmission line sheets are illustrated as being provided in FIG. 4, it is understood that any number of transmission line sheets may be provided adjacent to one another in the transmission line unit 210** according to various example embodiments. Thanks to the plurality of transmission line sheets 210-1, 210-2, and **210-*n*, a conductor loss of a MNG resonator may be effectively reduced. In a case in which the conductor loss of a single transmission line sheet is assumed to be R, the conductor loss may become R/2 when two transmission line sheets are arranged in parallel. The conductor loss of the MNG resonator may be reduced based on the number of the transmission line sheets included in the configuration of the transmission line unit 210**.

A current flow of each of the transmission line sheets 210-1, 210-2, and **210-*n* may have an in-phase form. Accordingly, the conductor loss of the MNG resonator may be reduced depending on the number of the transmission line sheets. The current flow of each of the transmission line sheets 210-1, 210-2, and 210-*n*** may have the in-phase form, and thus a characteristic of the MNG resonator or the power transmission efficiency may not vary regardless of a type of a medium being inserted between each of the transmission line sheets.

A resonator according to an example embodiment may reduce the conductor loss, and thus may have a high Q-factor. The resonator may be miniaturized, and may enhance a transmission efficiency and transmission distance.

The transmission line sheet configured in the transmission line unit 210 may include, for example, sheets of a thin film type, and may have a metal material. A shape of the transmission line unit may be, for example, a circle or a other geometric configuration besides a rectangle as illustrated in FIG. 2.

Figure 5:
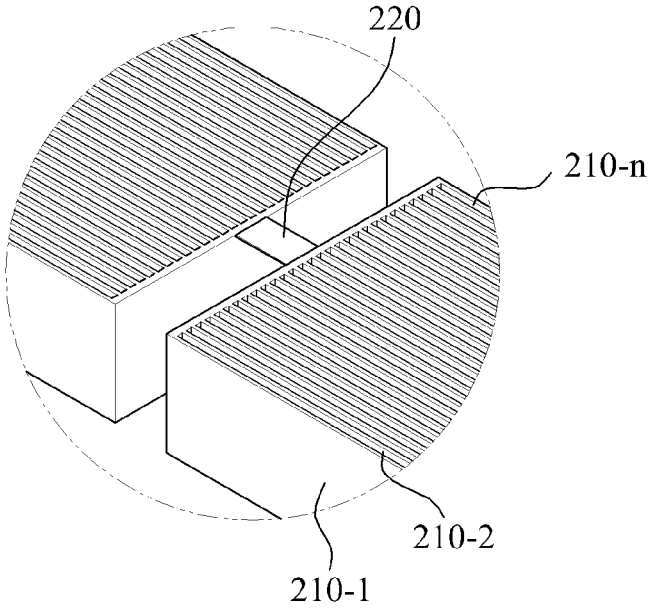
FIG. 5 is a diagram illustrating an inserting portion of the capacitor 220 of FIG. 2.

FIG. 5 is a diagram illustrating an inserting portion of the capacitor 220 of FIG. 2.

Referring to FIG. 5, the capacitor 220 may be inserted into an intermediate portion of the transmission line unit 210. In this example embodiment, the intermediate portion of the transmission line unit 210 may have an open area, and each of transmission line sheets 210-1, 210-2, and **210-*n*** may be connected in parallel in the intermediate portion.

According to an example embodiment, a resonance frequency may be independent with respect to a physical size of the resonator, and thus the resonator may be configured in a small size.

According to an example embodiment, a magnetic field may be configured to be dominant in a near field, thereby enhancing the power transmission efficiency in a short range.

According to an example embodiment, a resonator may have a high Q-factor by decreasing a conductor loss. The resonator may be miniaturized, and may enhance a transmission efficiency and a transmission distance.

Figure 6:
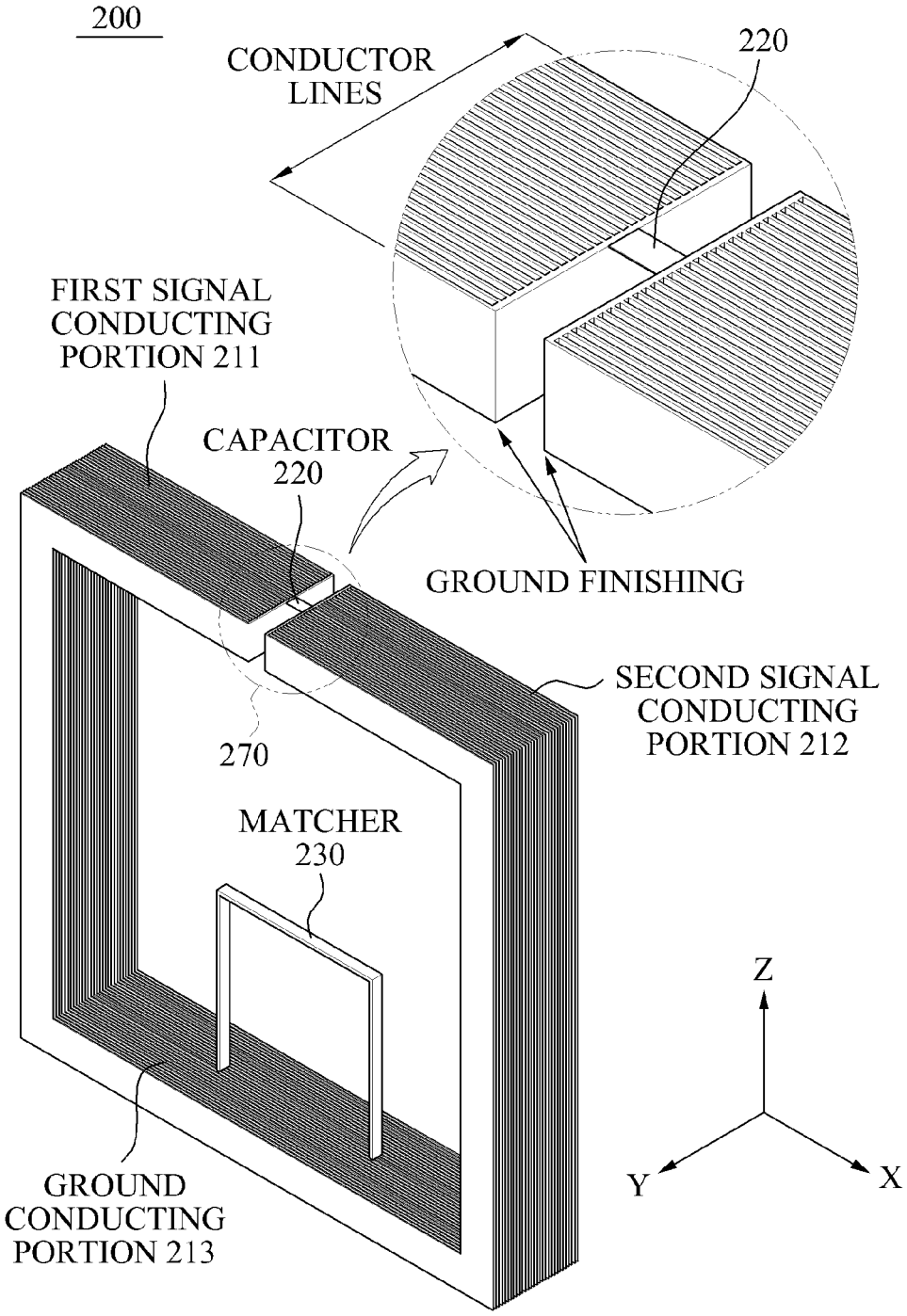
FIG. 6 is a diagram illustrating an example of the resonator of FIG. 3.

FIG. 6 is a diagram illustrating an example of the resonator 200 of FIG. 3.

Referring to FIG. 6, the parallel-sheet configuration may be applicable to each of the first signal conducting portion 211 and the second signal conducting portion 212 included in the resonator 200.

The first signal conducting portion 211 and/or the second signal conducting portion 212 may not be a perfect conductor, and thus may have a resistance. Due to the resistance, an ohmic loss may occur. The ohmic loss may decrease a Q-factor and also decrease a coupling effect.

The resonator 200 may have the structure illustrated in FIG. 6. The transmission line unit may include the first signal conducting portion 211 and the second signal conducting portion 212 in an upper portion of the resonator 200, and may include the ground conducting portion 213 in a lower portion of the resonator 200. The first signal conducting portion 211 and the second signal conducting portion 212 may be disposed to face the ground conducting portion 213. A current may flow in an x direction through the first signal conducting portion 211 and the second signal conducting portion 212. Due to the current, a magnetic field H(W) may be formed in a −y direction. Alternatively, unlike the diagram of FIG. 6, the magnetic field H(W) may be formed in a +y direction.

Also, the MNG resonator 200 may include the matcher 230 used in impedance matching. The matcher 230 may appropriately adjust the strength of magnetic field of the MNG resonator 200. An impedance of the MNG resonator 200 may be determined by the matcher 230.

By applying the parallel-sheet configuration to each of the first signal conducting portion 211 and the second signal conducting portion 212, it is possible to decrease the ohmic loss, and to increase the Q-factor and the coupling effect. Referring to a portion 270 indicated by a circle in FIG. 6, in an example embodiment in which the parallel-sheet configuration is applied, each of the first signal conducting portion 611 and the second signal conducting portion 212 may include a plurality of conductor lines. The plurality of conductor lines may be disposed in parallel, and may be shorted at an end portion of each of the first signal conducting portion 211 and the second signal conducting portion 212.

As described above, in an example embodiment in which the parallel-sheet configuration is applied to each of the first signal conducting portion 211 and the second signal conducting portion 212, the plurality of conductor lines may be disposed in parallel. Accordingly, a sum of resistances having the conductor lines may decrease. Consequently, the resistance loss may decrease, and the Q-factor and the coupling effect may increase.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A resonator for a wireless power transmission, the resonator comprising:

a transmission line unit comprising a plurality of transmission line sheets arranged in parallel, and configured to comprise an in-phase electric current flow; and a capacitor provided at a predetermined position of the transmission line unit.

2. The resonator of claim 1, wherein the capacitor is provided in series in an intermediate portion of the transmission line unit.

3. The resonator of claim 1, wherein the capacitor is configured so that the resonator comprises a property of a metamaterial.

4. The resonator of claim 1, wherein the capacitor is configured so that the resonator comprises a negative magnetic permeability at a target frequency.

5. The resonator of claim 1, wherein the transmission line unit is configured to comprise a parallel type conductor loss.

6. The resonator of claim 1, wherein the transmission line unit is configured such that a current supplied to the resonator is uniformly distributed on the plurality of transmission line sheets.

7. The resonator of claim 1, further comprising:

a magnetic core configured to pass through the transmission line unit.

8. A resonator for a wireless power transmission, the resonator comprising:

a plurality of transmission lines provided adjacent to one another;

a capacitor provided at a gap in the transmission lines; and a matcher configured to adjust a magnetic held strength of the resonator, wherein the capacitor is provided opposite to the matcher in the resonator.

9. The resonator of claim 8, wherein the capacitor is provided in series with the transmission lines.

* * * * *